US012751556B2

(12) United States Patent
Checchin et al.

(10) Patent No.: US 12,751,556 B2
(45) Date of Patent: Oct. 6, 2026

(54) FURNISHING COMPOSITION COMPRISING A PLURALITY OF MODULAR MODULES WITH VARIABLE CONFIGURATION

(71) Applicant: ARPER S.P.A., Monastier di Treviso (IT)

(72) Inventors: Claudio Checchin, Monastier di Treviso (IT); Isil Sati, Monastier di Treviso (IT)

(73) Assignee: ARPER S.P.A., Monastier di Treviso (IT)

( * ) Notice: Subject to any disclaimer, the term of this patent is extended or adjusted under 35 U.S.C. 154(b) by 27 days.

(21) Appl. No.: 18/629,279

(22) Filed: Apr. 8, 2024

(65) Prior Publication Data

US 2024/0341487 A1 Oct. 17, 2024

(30) Foreign Application Priority Data

Apr. 12, 2023 (IT) ..... 102023000007023

(51) Int. Cl.
*A47C 13/00* (2006.01)
*A47C 4/02* (2006.01)

(52) U.S. Cl.
CPC ..... *A47C 13/005* (2013.01); *A47C 4/02* (2013.01)

(58) Field of Classification Search
CPC ..... A47C 13/005
See application file for complete search history.

(56) References Cited

U.S. PATENT DOCUMENTS 3,129,472 A * 4/1964 Hensel ..... F16B 12/22 403/231
2009/0045666 A1 2/2009 Westendorf et al.
2024/0108145 A1* 4/2024 Armond ..... A47C 13/005

FOREIGN PATENT DOCUMENTS

JP S62157461 U 10/1987

OTHER PUBLICATIONS

Italian Search Report for Patent Application No. IT 202300007023, mailed Nov. 15, 2023, The Hague, NL.

* cited by examiner

*Primary Examiner* — Justin Michael Heston
(74) *Attorney, Agent, or Firm* — Armstrong Teasdale LLP

(57) ABSTRACT

A furnishing composition having a plurality of furnishing modules that can be assembled according to a variable configuration is provided. Each furnishing modules is provided with a support frame having a support base and at least one engagement seat directed along a vertical axis perpendicular to a support plane of the furnishing composition, and at least one connecting rod having an arm ending, at opposite ends, with a pair of fixing pins projecting perpendicularly to the arm. The fixing pins are at least partially counter-shaped with respect to the engagement seats so as to be engaged in the engagement seats according to a shape coupling. The fixing pins of the at least one connecting rod are engaged in respective engagement seats of two furnishing modules adjacent to each other.

15 Claims, 6 Drawing Sheets

FURNISHING COMPOSITION COMPRISING A PLURALITY OF MODULAR MODULES WITH VARIABLE CONFIGURATION

CROSS-REFERENCE TO RELATED APPLICATION

This application claims priority to Italian Patent Application No. 102023000007023, filed Apr. 12, 2023, the entire contents of which is hereby incorporated in its entirety by reference.

FIELD OF APPLICATION

The present invention relates to a furnishing composition comprising a plurality of modular modules with variable configuration. In particular, the present invention finds application in indoor or outdoor furnishings comprising several modules which can be placed side by side and mechanically connected to one another in different configurations, according to the user's needs.

BACKGROUND ART

In the prior art, there are solutions of furnishing compositions comprising furnishing elements that can be assembled together by means of mechanical joints.

However, such solutions are inconvenient to assemble and especially do not allow the modules to be repeatedly disassembled and reassembled quickly and easily, without the use of specific tools.

Moreover, the solutions of the prior art allow limited reconfigurations, i.e., repositioning, of the various modules forming the furnishing composition.

Moreover, the known solutions often imply irreversible marks on the individual modular modules upon fastening them: the subsequent reconfiguration of the furnishing composition is thus discouraged since it would leave such marks in sight.

In other words, the known solutions do not allow the user to reconfigure the arrangement of the modules of the furnishing composition at will, according to contingent needs, quickly and without the aid of specific tools.

SUMMARY OF THE INVENTION

The need is thus felt to overcome the drawbacks and limitations mentioned with reference to the prior art.

Such a need is met by a furnishing composition as described and claimed herein.

DESCRIPTION OF THE DRAWINGS

Further features and advantages of the present invention will become more comprehensible from the following description of preferred, non-limiting embodiments thereof, in which.

The elements or parts of elements common to the embodiments described below will be indicated by the same reference numerals.

DETAILED DESCRIPTION

Figure 1:
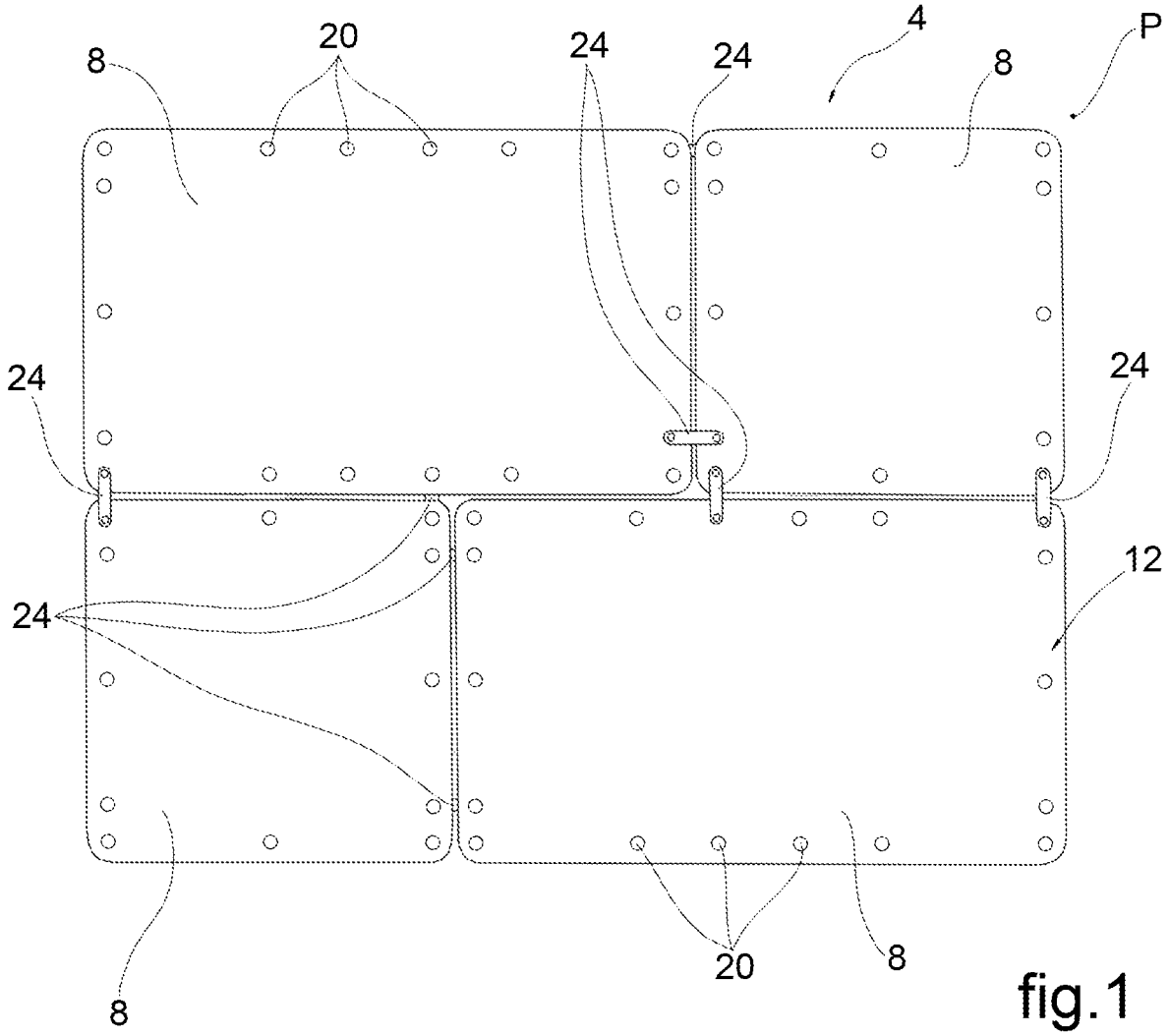
FIG. 1 shows a top plan view, in assembly configuration, of a furnishing composition comprising a plurality of modular modules in accordance with an embodiment of the present invention.
Figure 2:
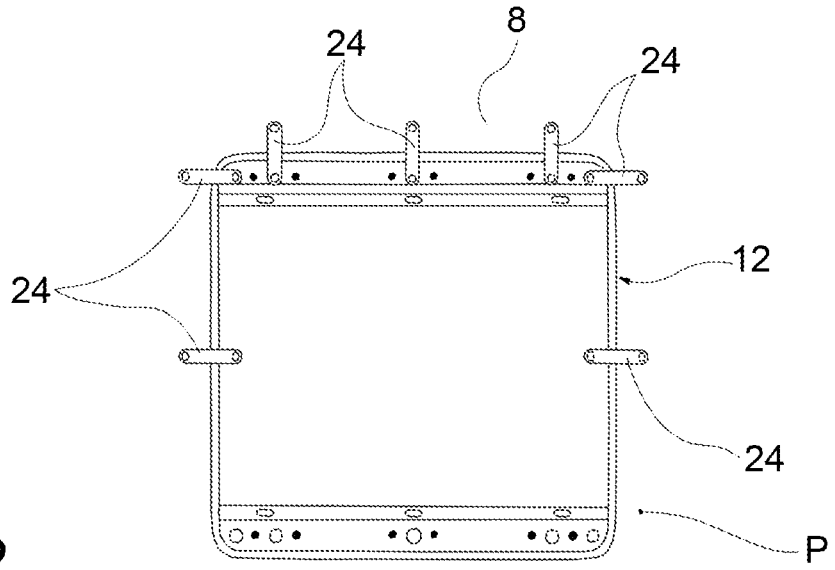
FIG. 2 shows a bottom plan view of a modular module of the furnishing composition of FIG. 1.

With reference to the figures, 4 indicates as a whole a furnishing composition comprising a plurality of furnishing modules 8 that can be assembled according to a variable configuration.

The term furnishing module 8 must be understood in a broad sense, comprising, merely by way of non-limiting example, armchairs, chairs, sofas, beds, ottomans, and the like.

Each of said furnishing modules 8 is provided with a support frame 12 having a support base 16 and at least one engagement seat 20, directed along a vertical axis Y-Y, perpendicular to a support plane P of the furnishing composition 4. The support frame 12 and the engagement seat 20 can be made of any material.

Each furnishing module 8 is further provided with at least one connecting rod 24 comprising an arm 28 ending, at opposite ends, with a pair of fixing pins 32,36 projecting perpendicularly to said arm 28.

Said fixing pins 32,36 are at least partially counter-shaped with respect to said engagement seats 20 so as to be engaged in said engagement seats 20 according to a shape coupling.

More in detail, the fixing pins 32,36 of said at least one connecting rod 24 are engaged in respective engagement seats 20 of two furnishing modules 8 adjacent to each other. The connecting rod 24 is thus capable of mechanically connecting said adjacent furnishing modules 8 to each other.

Preferably, the engagement seat 20 and the fixing pins 32,36 are axialsymmetric with respect to an axis of axialsymmetry S-S parallel to said vertical axis Y-Y.

For example, said engagement seat 20 and said fixing pins 32,36 are cylindrical or conical. It is thus possible to mutually rotate the connecting rod 24 and the engagement seats 20 so as to vary the orientation and/or the relative position between adjacent furnishing modules 8. For example, in the case of a conical configuration, the fixing pins 32,36 have a vertex angle between 15° and 25°, preferably 20°.

Figure 10:
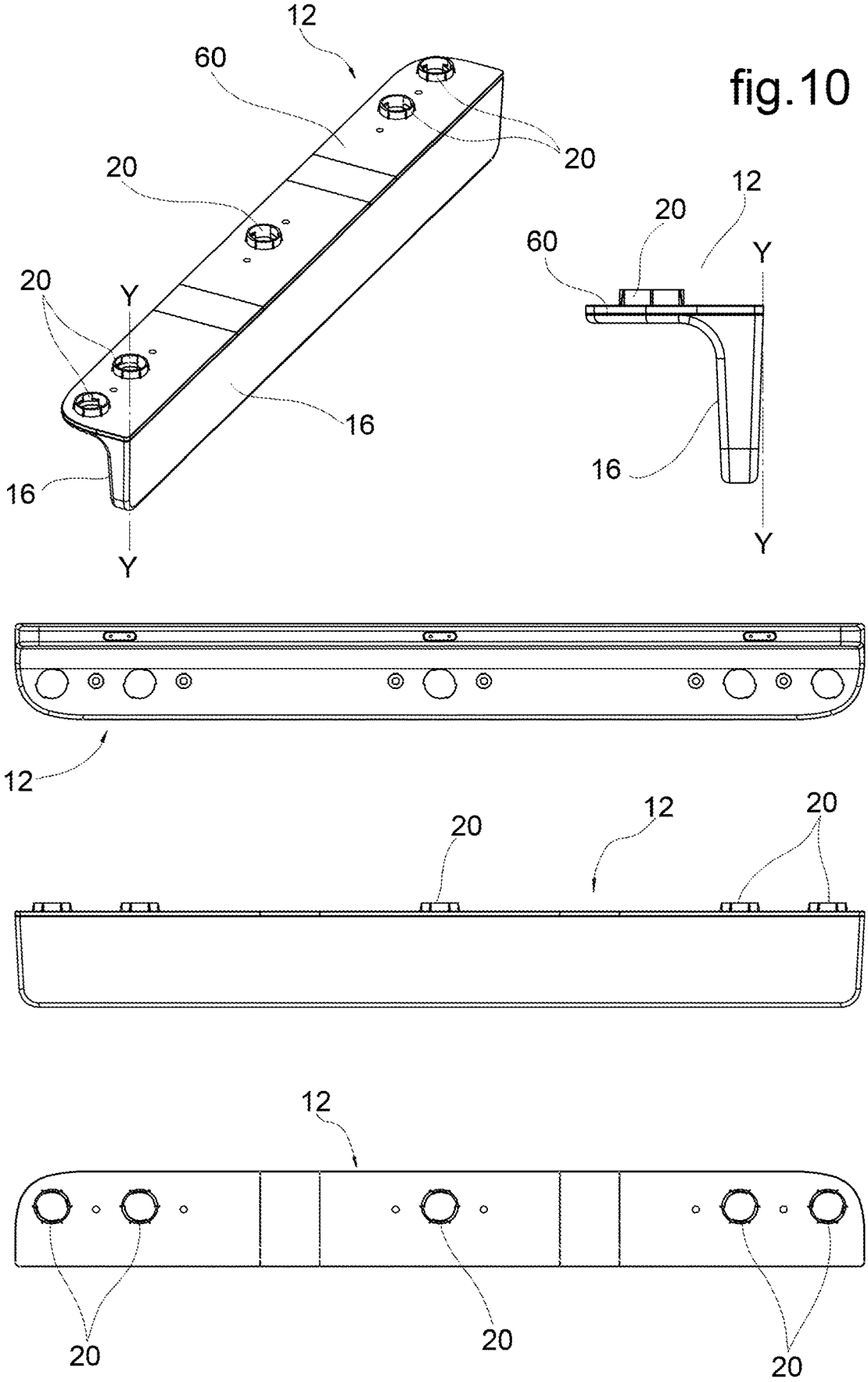
FIG. 10 shows various views, from different angles, of a support frame of a furnishing module in accordance with an embodiment of the present invention.
Figure 11:
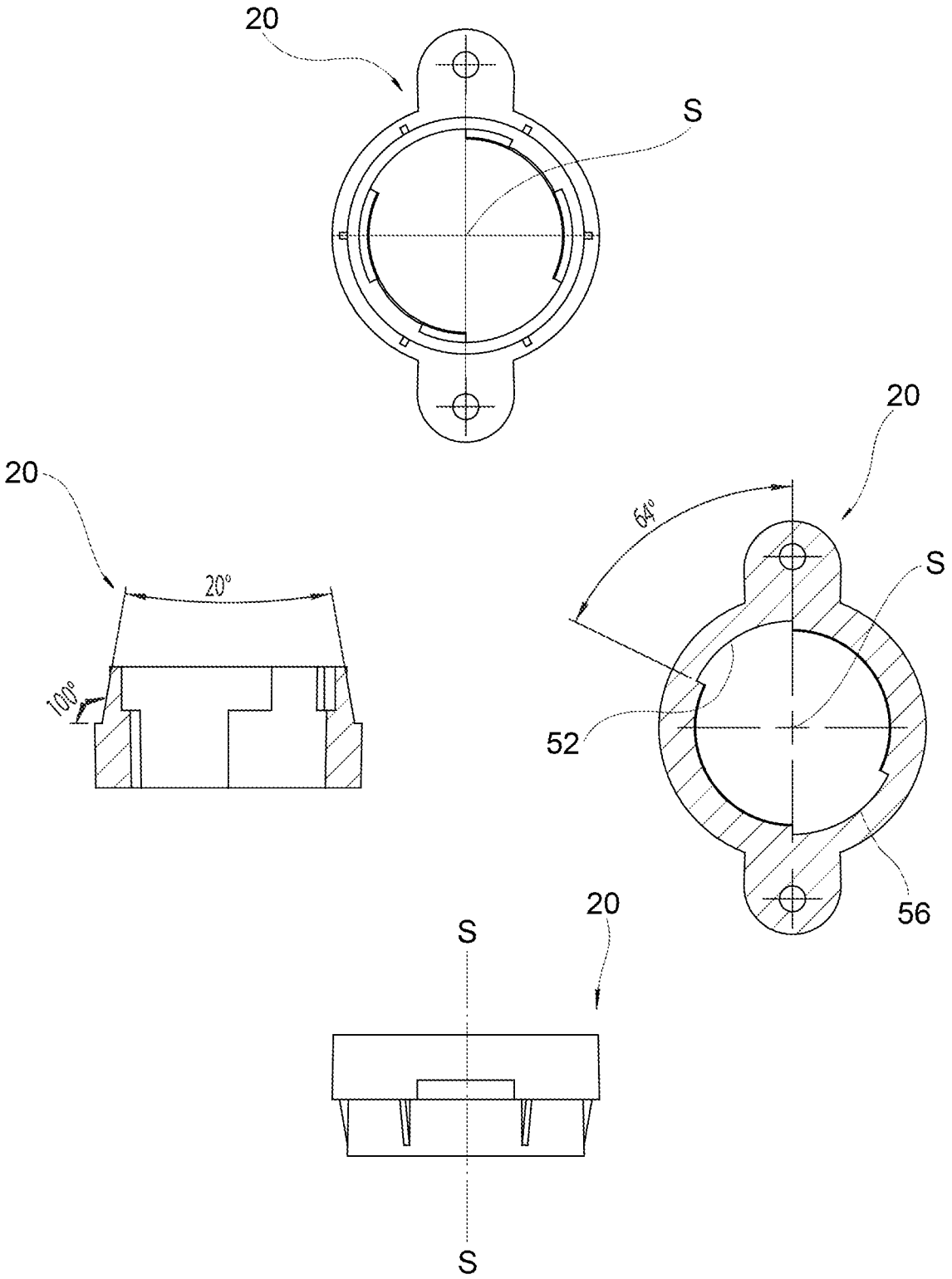
FIG. 11 shows various views, from different angles, of an engagement seat carried on a furnishing module in accordance with an embodiment of the present invention.

The engagement seat 20 can be in one piece with the support frame 12; alternatively (FIG. 10) said engagement seat 20 can be carried on the support frame 12 by fixing means which can comprise perforated bases and related fixing screws.

Preferably, said engagement seats 20 are open downwards, i.e., facing the support plane P of the furnishing composition 4.

The fixing pins 32,36 face upwards, on the opposite side of the support plane P of the furnishing composition 4. The fixing pins 32,36 can thus be inserted into the respective engagement seats 20 with a movement from the bottom upwards.

In accordance with a possible embodiment, in each connecting rod 24, at least one of said fixing pins 32,36 is provided with bayonet attachments 44,48 arranged in diametrically opposite positions: moreover, at least one of said engagement seats 20 is provided with diametrically opposite radial gaps 52,56, shaped so as to create a mechanical connection with said bayonet attachments 44,48.

In accordance with a possible embodiment, in the assembly configuration, the radial gaps 52, 56 are misaligned with respect to the bayonet attachments 44, 48. Preferably, an angular offset is provided, which is between 45 and 75 degrees, preferably of 65 degrees.

In accordance with a possible embodiment, the connection between two adjacent furnishing modules 8 occurs by interposing two connecting rods 24, each having a fixing pin 32,36 provided with bayonet attachments 44,48, inserted into the respective engagement seat 20, in turn provided with radial gaps 52,56, by virtue of an opposing (clockwise/counterclockwise) movement which brings said connecting rods 24 to a position substantially orthogonal to the coupling side. This type of coupling prevents the adjacent furnishing modules 8, connected to each other, from misaligning: such movement is prevented as the connecting rods arranged as above are not free to rotate on the same side.

Preferably, the bayonet attachments 44,48 of said fixing pins 32,36 are aligned and symmetrical along the joining centres C1,C2 of the fixing pins 32,36 of the connecting rod 24.

In accordance with a possible embodiment, the engagement seats 20 are through with respect to the support frame 12. Moreover, said fixing pins 32,36 are shaped so that, in the assembly configuration on the engagement seats 20, they completely cross the engagement seats 20 and protrude from the upper part of the engagement seats 20, opposite to the support plane P of the furnishing composition 4.

Preferably, the support frame 12 of each furnishing module 8 is provided with a plurality of engagement seats 20, in one piece or carried, arranged peripherally with respect to the support frame 12. It is thus possible to vary the connection points between adjacent furnishing modules 8, varying the engagement position of the fixing pins 32,36 of the related connecting rods 24.

In accordance with a possible embodiment, the support frame 12 is provided with the support base 16, directed in a vertical direction Y-Y, and a horizontal cantilevered portion 60 which supports said at least one engagement seat 20, said support base 16 being retracted or internal with respect to the horizontal cantilevered portion 60.

In accordance with a possible embodiment, said fixing pins 32,36, on the opposite side of the respective engagement seats 20, are provided with an extraction nail 64, adapted to facilitate the disassembly of the connecting rod 24, allowing the traction of the connecting rod 24 towards the support plane P of the furnishing composition 4. For example, the user can insert the tip of a finger or a screwdriver to pull the connecting rod 24 downwards, levering the extraction nail 64 which acts as an undercut towards the support plane P.

The method of assembling a furnishing composition according to the present invention will now be described.

Figure 3:
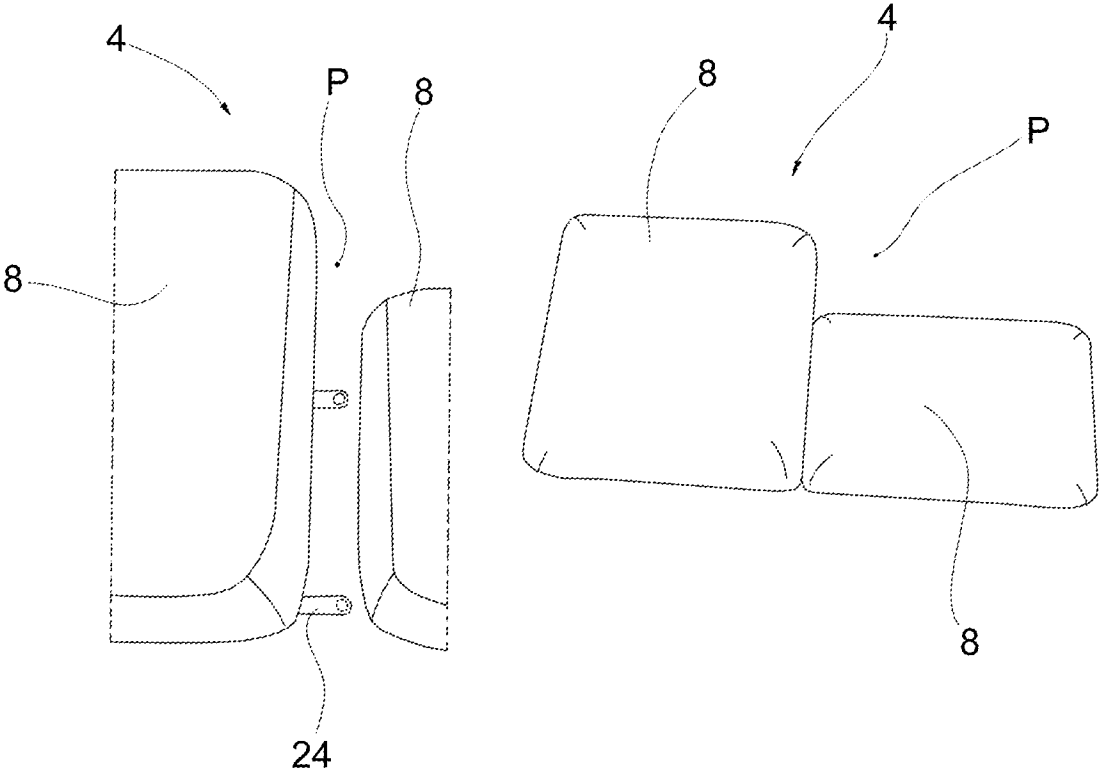
FIG. 3 shows a top view of two subsequent assembly steps of a furnishing composition comprising a plurality of modular modules according to an embodiment of the present invention.
Figure 4:
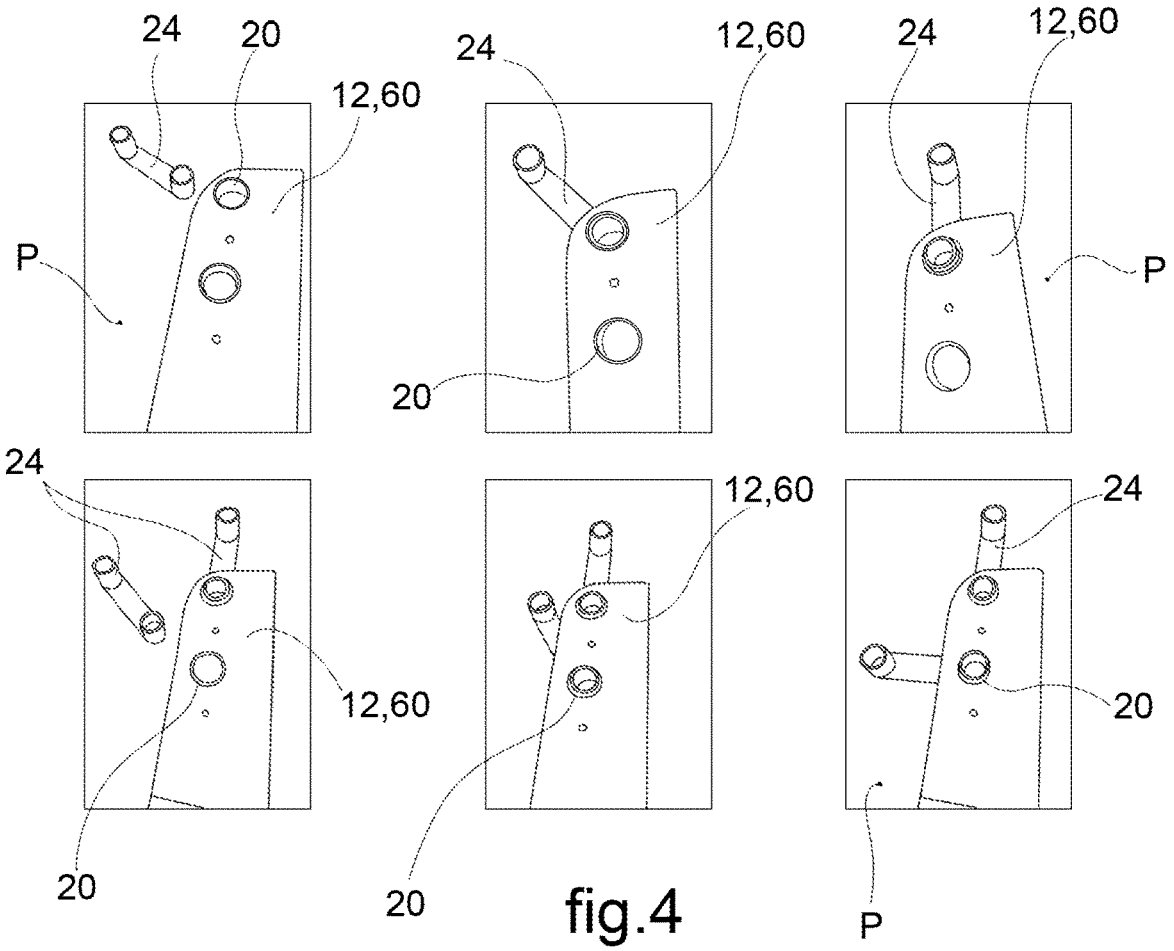
FIG. 4 shows a top view of subsequent assembly steps of a modular module, without a seat, in accordance with an embodiment of the present invention.
Figure 5:
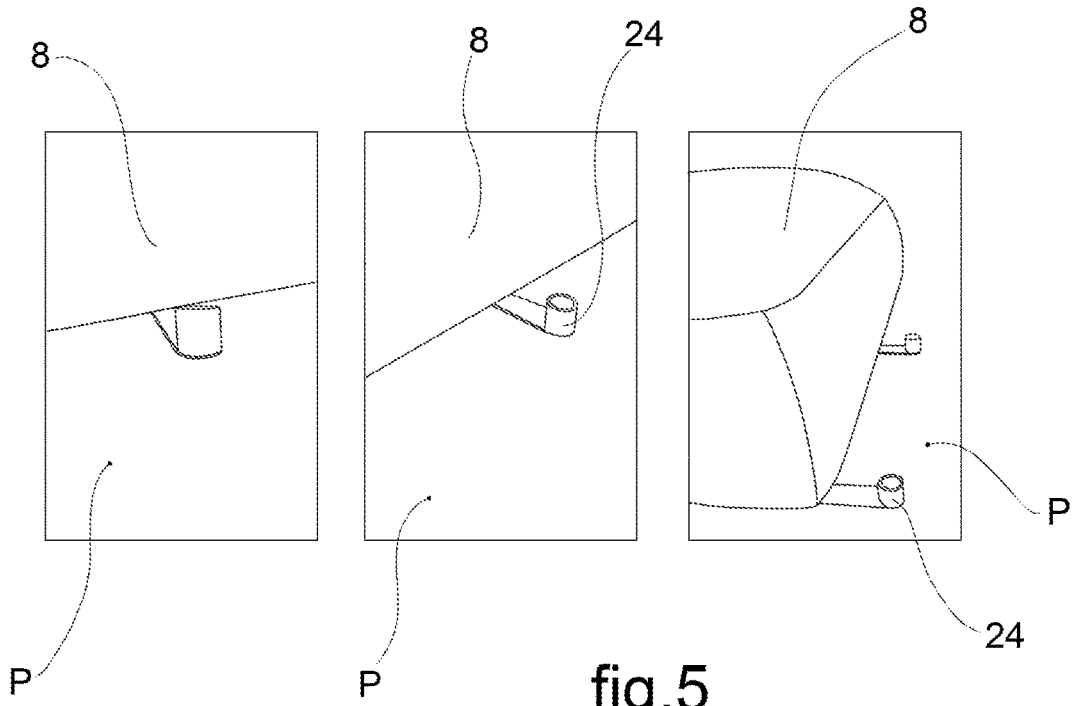
FIG. 5 shows a to perspective view of subsequent assembly steps of a modular module, provided with a seat, in accordance with an embodiment of the present invention.
Figure 6:
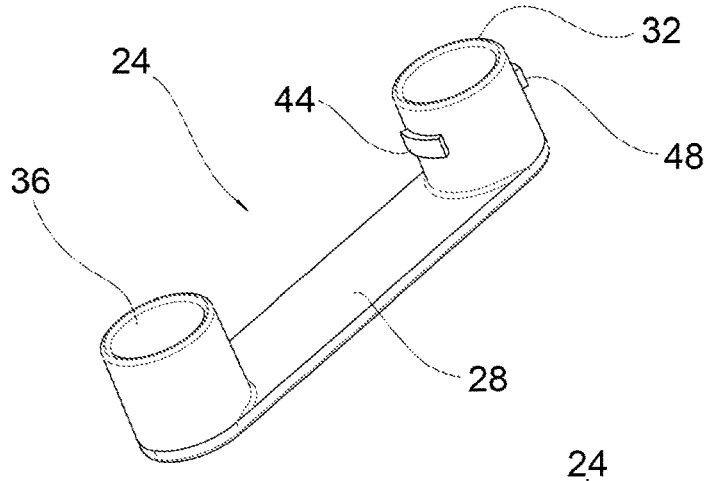
FIG. 6 shows a perspective view of a connecting rod for modular modules, in accordance with an embodiment of the present invention.
Figure 7:
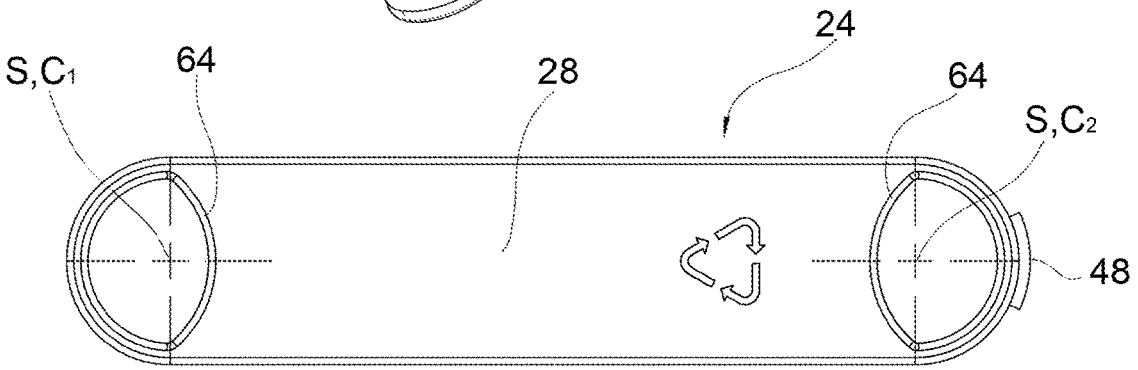
FIG. 7 shows a bottom plan view of the connecting rod of FIG. 6.
Figure 8:
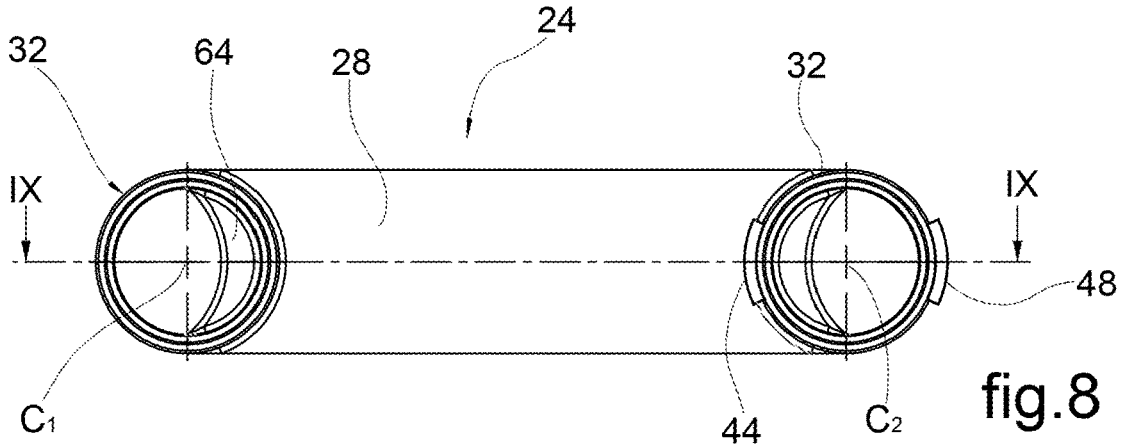
FIG. 8 shows a top plan view of the connecting rod of FIG. 6.
Figure 9:
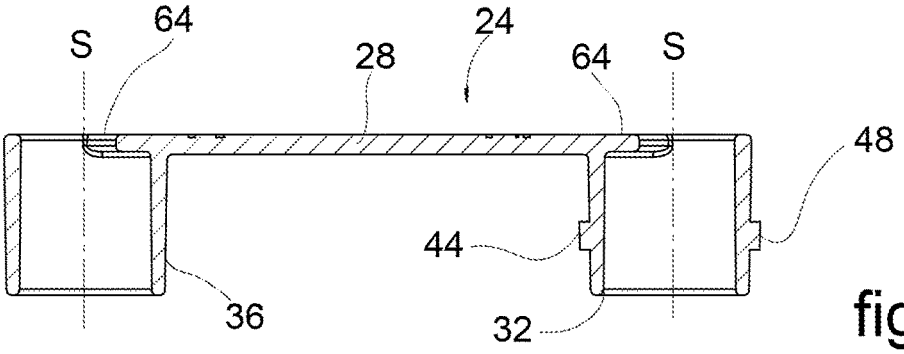
FIG. 9 shows a sectional view of the connecting rod of FIG. 6, along the section plane IX-IX indicated in FIG. 8.

In particular, the user begins to apply a connecting rod 24 (FIGS. 3-5) to the support frame 12 of a furnishing module 8. In more detail, he/she inserts a fixing pin 32 into an engagement seat 20, according to a shape coupling, from the bottom upwards. Then he/she adjusts the angular orientation of the arm 28, rotating the fixing pin 32, previously inserted, with respect to said engagement seat. In the case of bayonet attachments 44,48, after having engaged said bayonet attachments 44,48 in the respective radial gaps 52,56, the user rotates the connecting rod 24 so as to angularly offset the bayonet attachments 44,48 with respect to the radial gaps 52,56.

Then he/she proceeds with the juxtaposition of a second furnishing module 8 to the fixing pin 36 left free and cantilevered and the latter is engaged in a corresponding engagement seat 20 obtained or carried on the support frame 12 of said second furnishing module 8. The possible combinations of the furnishing composition 4 are varied and can be continuously modified by moving the orientations and fixing points of the connecting rod 24, i.e., by choosing appropriate engagement seats 20 present along the perimeters of the support frames 12 of the various furnishing modules 8.

The disassembly of the connecting rod 24 can be facilitated by levering the extraction nails provided for this purpose at the fixing pins 32,36.

Moreover, as mentioned above, it is possible to connect two adjacent furnishing modules 8 by interposing two connecting rods 24, each having a fixing pin 32,36 provided with bayonet attachments 44,48, inserted into the respective engagement seat 20, in turn provided with radial gaps 52,56, by virtue of an opposing (clockwise/counterclockwise) movement which brings said connecting rods 24 to a position substantially orthogonal to the coupling side. This inverted coupling prevents the adjacent furnishing modules 8, connected to each other, from misaligning: such movement is prevented as the connecting rods arranged as above are not free to rotate on the same side. Otherwise, the connecting rods 24 could move synchronously as in an articulated parallelogram, allowing unwanted relative movements between adjacent furnishing modules.

As can be appreciated from the above description, the present invention allows overcoming the drawbacks of the prior art.

In particular, the present invention allows reconfiguring the furnishing composition at will, without the aid of specific tools, quickly and easily.

The configurations are all reversible, can be assembled and disassembled repeatedly, and the related fixings are not visible from the outside by an observer.

In order to meet specific contingent needs, those skilled in the art may make several changes and variations to the solutions described above.

The scope of protection of the invention is defined by the following claims.

What is claimed is:

1. A furnishing composition comprising:

a plurality of furnishing modules which are modular according to a variable configuration, wherein each of said furnishing modules is provided with a support frame having a support base and at least one engagement seat, directed along a vertical axis, perpendicular to a support plane of the furnishing composition, at least one connecting rod comprising an arm ending, at opposite ends, with a pair of fixing pins projecting perpendicularly to said arm, said fixing pins being at least partially counter-shaped with respect to said engagement seats so as to be engaged in said engagement seats according to a shape coupling, and wherein the fixing pins of said at least one connecting rod are engaged in respective engagement seats of two furnishing modules adjacent to each other, wherein said fixing pins, on a side opposite the respective engagement seats, are provided with an extraction nail, adapted to facilitate a disassembly of the connecting rod allowing traction of the connecting rod towards the support plane of the furnishing composition.

2. The furnishing composition of claim 1, wherein said at least one engagement seat and said fixing pins are axial-symmetric with respect to an axis of axial-symmetry parallel to said vertical axis.

3. The furnishing composition of claim 1, wherein said at least one engagement seat and said fixing pins are cylindrical or conical.

4. The furnishing composition of claim 1, wherein said at least one engagement seat is integral with the support frame.

5. The furnishing composition of claim 1, wherein said at least one engagement seat is carried on the support frame by fixing means.

6. The furnishing composition of claim 1, wherein said engagement seats are open downwards, facing the support plane of the furnishing composition.

7. The furnishing composition of claim 1, wherein the fixing pins are facing upwards, on a side opposite the support plane of the furnishing composition.

8. The furnishing composition of claim 1, wherein in each connecting rod, at least one of said fixing pins is provided with bayonet attachments, arranged in diametrically opposite positions to each other, and wherein at least one of said engagement seats is provided with radial gaps, diametrically opposite each other, shaped so as to create a mechanical connection with said bayonet attachments.

9. The furnishing composition of claim 8, wherein, in an assembly configuration, the radial gaps are misaligned with respect to the bayonet attachments.

10. The furnishing composition of claim 8, wherein a connection between two adjacent furnishing modules occurs by interposing two connecting rods, each having a fixing pin provided with bayonet attachments, inserted in the respective engagement seat provided with radial gaps, by virtue of an opposite clockwise/counter-clockwise movement which brings said two connecting rods in a position substantially orthogonal to a coupling side of the two furnishing modules.

11. The furnishing composition of claim 8, wherein the bayonet attachments of said fixing pins are aligned and symmetrical along joining centres of the fixing pins of the connecting rod.

12. The furnishing composition of claim 1, wherein said at least one engagement seat is through with respect to the support frame.

13. The furnishing composition of claim 1, wherein said fixing pins are shaped so that, in an assembly configuration on the engagement seats, the fixing pins completely cross the engagement seats and protrude from an upper part of the engagement seats, opposite the support plane of the furnishing composition.

14. The furnishing composition of claim 1, wherein the support frame of each furnishing module is provided with a plurality of engagement seats arranged peripherally with respect to the support frame.

15. The furnishing composition of claim 1, wherein the support frame is provided with the support base, directed in a vertical direction, and the support frame further comprises a horizontal cantilevered portion that supports said at least one engagement seat, wherein said support base extends from the horizontal cantilevered portion adjacent a first edge of the support frame and is spaced from an opposite second edge of the horizontal cantilevered portion.

* * * * *